US005752124A

United States Patent [19]

Glover et al.

[11] Patent Number: 5,752,124

[45] Date of Patent: May 12, 1998

[54] HANDLING OF SOLUTIONS

[75] Inventors: Edward Charles Glover, London; Anthony Earle, Harrow Weald, both of England

[73] Assignee: Eastman Kodak Company, Rochester, N.Y.

[21] Appl. No.: 632,992

[22] Filed: Apr. 16, 1996

[30] Foreign Application Priority Data

Apr. 18, 1995 [GB] United Kingdom ..... 9507845

[51] Int. Cl.[6] ..... G03D 3/02

[52] U.S. Cl. ..... 396/626

[58] Field of Search ..... 396/626, 630, 396/636; 118/326; 137/265, 175; 206/219; 222/50; 226/403

[56] References Cited

U.S. PATENT DOCUMENTS

| | | | |
|---|---|---|---|
| 3,900,866 | 8/1975 | Bell et al. | 118/326 |
| 4,197,942 | 4/1980 | Gacki et al. | 206/219 |
| 4,613,060 | 9/1986 | Ulbrich et al. | 137/265 |
| 5,199,594 | 4/1993 | Obara et al. | 220/403 |
| 5,353,085 | 10/1994 | Kurematsu et al. | 354/324 |

FOREIGN PATENT DOCUMENTS

| | | | |
|---|---|---|---|
| 0 227 358 B1 | 12/1986 | European Pat. Off. | G03C 3/06 |
| 0 276 994 | 1/1988 | European Pat. Off. | B65D 77/06 |
| 0 500 371 A2 | 2/1992 | European Pat. Off. | G03D 3/06 |
| 2647919 | 5/1990 | France | G03D 3/06 |
| 86 20 048.8 | 8/1987 | Germany | G03D 3/06 |
| 1363136 | 8/1970 | United Kingdom | G03D 3/06 |

*Primary Examiner*—D. Rutledge

*Attorney, Agent, or Firm*—Charles E. Snee, III; Gordon M. Stewart

[57] ABSTRACT

Described herein is an arrangement which allows solution to be supplied to a process from a 'bag-in-box' arrangement, used solution being returned to an emptied 'bag-in-box' arrangement for disposal. The arrangement includes a process (40) having an inlet (46) and an outlet (48) which is connected to a valve arrangement (10) by way of the inlet (46) and outlet (48). Respective 'bag-in-box' arrangements (62, 64) are connected to the valve arrangement (10) which determines whether the 'bag-in-box' arrangement is connected to the inlet (46) or the outlet (48) by its position. The arrangement provides a system in which new 'bag-in-box' arrangements containing fresh solution for the process (40) are connected to inlet (46) thereof regardless of their relative positioning. Using the valve arrangement (10), the number of connections and disconnections for the 'bag-in-box' arrangements is halved.

8 Claims, 5 Drawing Sheets

INLET SIDE
OUTLET SIDE 80
82
M 84
80'
M'

86
84'
M''
86'

X
Y
STATE OF VALVE 10

90
'UP'
94

90'
'DOWN'
96

92
'UP'
96'

92'
'DOWN'
98

HANDLING OF SOLUTIONS

FIELD OF THE INVENTION

The present invention relates to improvements in or relating to the handling of solutions and is more particularly, although not exclusively, concerned with the handling of photographic processing solutions.

BACKGROUND OF THE INVENTION

It is known to supply processing solutions to a photographic process using a flexible bag having two compartments each having a port connected thereto. One of the compartments contains processing solution for supplying to a photographic process and the other is empty and is designed to receive used processing solution. Such an arrangement is described in FR-A-2 647 919.

It is also known to supply processing solutions from 'bag-in-box' arrangements which comprise an outer liquid-tight container or box inside which a flexible bag containing processing solution is located. The arrangement has two connections—a first connection between the flexible bag and the outside of the container, and a second connection between the outside of the container and the space between the flexible bag and the outer container. Processing solution is fed from the bag via the first connection to an appropriate photographic process, and used processing solution is returned to the container from the process through the second connection. This means that processing solution can be stored in a container, supplied to a process from that container, and returned thereto when used or exhausted for disposal. Such an arrangement is described in GB-A-1 363 136.

Other 'bag-in-box' arrangements are also described in EP-A-0 284 024 and EP-A-0 227 358.

In the flexible bag arrangement and the 'bag-in-box' arrangements described above, at least two connections are provided, one connection through which solution is supplied to the process and one connection through which used or waste solution is collected therefrom.

Other or 'bag-in-box' arrangements are known, for example, as described in EP-A-0 500 371, which utilise a single connector between the inner flexible bag and the exterior of the container, the solution being removed from and returned to the inner flexible bag through the single connector. Problem to be solved by the Invention In flexible container or 'bag-in-box' arrangements where a single connector is provided connecting the inner flexible bag to the exterior of the container, it is necessary, in many cases, to move the container when it has been emptied in order to reuse it to collect used solution. This arrangement has the disadvantage that the single connector of this type of flexible container or 'bag-in-box' arrangement has to be connected to the process supply, disconnected therefrom when the bag has been emptied, and subsequently re-connected to the process waste as there is no provision for being able to supply and collect at the same time.

It will be appreciated that 'bag-in-box' arrangements as described in GB-A-1 363 136, EP-A-0 284 024 and EP-A-0 227 358 do not suffer from this connection problem, but do have at least twice the number of connectors thereby increasing the cost of providing the 'bag-in-box' arrangement.

SUMMARY OF THE INVENTION

It is an object of the present invention to provide a valve arrangement which allows processing solution to be supplied to a photographic process from a flexible container having a single connector, and used solution returned thereto without having to move the flexible container until it has been filled with used processing solution.

In accordance with one aspect of the present invention, there is provided a method of handling processing solutions for a photographic process using at least one flexible container capable of containing processing solution, the flexible container having a single connector by which it is connected to the process, the process having an inlet side through which fresh processing solution is introduced thereto and an outlet side from which used processing solution is removed therefrom, the method comprising the steps of:

a) providing at least one flexible container connected to the inlet side of the process for supplying processing solution thereto, the supply flexible container being initially substantially full of fresh processing solution;

b) providing at least one flexible container connected to the outlet side of the process for collecting used processing solution therefrom, the waste flexible container being initially substantially empty;

c) supplying fresh processing solution to the inlet side of the process;

d) collecting used processing solution from the outlet side of the process;

e) removing each waste flexible container from the outlet side of the process when it is substantially full;

f) switching each substantially emptied supply flexible container from the inlet side of the process to the outlet side of the process to replace a respective one of the removed flexible container;

g) providing at least one further supply flexible container; and h) connecting each further flexible container to the inlet side of the process;

characterized in that step f) is carried out by a valve arrangement with no physical movement of each flexible container.

The term 'process' is intended to include apparatus for carrying out such a process, for example, a photographic processor.

Preferably, each supply and waste flexible container is located in respective first and second positions relative to the process, steps e), g) and h) being carried out in alternately in the first or second position, the valve arrangement effectively switching connections between each flexible container and the inlet and outlet sides of the process.

In accordance with a second aspect of the present invention, there is provided a valve arrangement for use in the method described above, the apparatus comprising:

a body portion;

a first port for connection to the inlet side of the process;

a second port for connection to the outlet side of the process;

third and fourth ports for connection to respective ones of the supply and waste flexible container; and fluid connection means for connecting the first and second ports with the third and fourth ports;

characterized in that the fluid connection means includes a switching arrangement for selectively connecting the first port with either one of the third and fourth ports and the second port with the other of the third and fourth ports.

By the term 'flexible container' is meant any sealed container where no air enters as solution is withdrawn therefrom or added thereto. This includes, in particular, 'bag-in-box' arrangement which comprise an outer liquid-tight container inside which a flexible bag is located.

Advantageously, the selective connection is effected simultaneously.

In accordance with another aspect of the present invention, there is provided a photographic process incorporating a valve arrangement as described above.

ADVANTAGEOUS EFFECT OF THE INVENTION

The valve arrangement in accordance with the present invention reduces the cost associated with the 'bag-in-box' arrangements as described in GB-A-1 363 136, EP-A-0 284 024 and EP-A-0 227 358 as a single connector is required.

In addition, the number of movements required to move the flexible container or 'bag-in-box' arrangement from the 'supply' side of a process to the 'waste' side is reduced.

The present invention is particularly advantageous where the supply or replenishment solutions are delivered at working strength to the process and where no drain is available and the waste or used solutions must be hauled away.

BRIEF DESCRIPTION OF THE DRAWINGS

For a better understanding of the present invention, reference will now be made, by way of example only, to the accompanying drawings in which.

DETAILED DESCRIPTION OF THE INVENTION

The present invention is applicable to flexible containers as described above, and will be described in more detail with reference to 'bag-in-box' arrangements, each having a self-sealing, dry break connector through which fluid connection is made. However, it will be readily appreciated that the present invention is not limited to use with such 'bag-in-box' arrangements.

Figure 1:
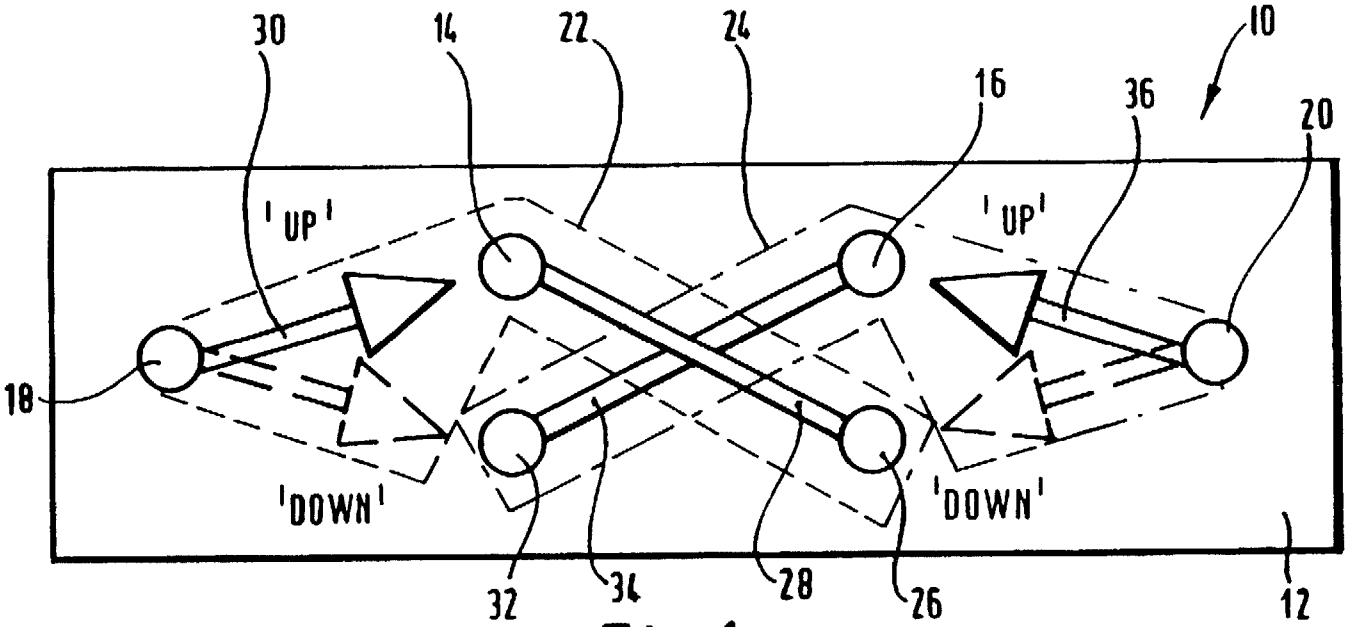
FIG. 1 is a schematic illustration of one embodiment of a valve arrangement in accordance with the present invention.

Referring initially to FIG. 1, a valve arrangement 10 in accordance with the present invention is shown schematically. The valve arrangement 10 comprises a body portion 12 in which are formed ports 14, 16, 18, 20. Ports 14, 16 are respectively connected to inlet and outlet sides of a process (shown in FIG. 2). Ports 14, 16 will hereafter be referred to as the 'inlet' port and the 'outlet' port respectively by virtue of their connection to the inlet and outlet sides of a process. Ports 18, 20 are connectable to 'bag-in-box' arrangements, shown in FIG. 2, which will be described in detail later.

Two-way valves 22, 24, arranged in a crossover configuration as shown, make the necessary connections between ports 14, 16 and respective ports 18, 20. The outline of valve 22 is shown as dashed lines and the outline of valve 24 as dot-dashed lines. Valve 22 comprises a port 26, a fixed fluid connection member 28 and a movable fluid connection member 30. Similarly, valve 24 comprises a port 32, a fixed fluid connection member 34 and a movable fluid connection member 36. Depending on the positioning of movable fluid connection members 30, 36, connection is made between ports 14, 16 and a respective one of ports 18, 20.

As shown in FIG. 1, when the movable connection members 30, 36 are in a first position, indicated by solid lines, respective connections are made between 'inlet' port 14 and port 18, and 'outlet' port 16 and port 20. When the movable connection members 30, 36 are in a second position, indicated by dashed lines, respective connections are made between 'inlet' port 14 and port 20, and 'outlet' port and port 18.

Members 30, 36 can be operated by suitable means (not shown) which enable them to be linked together so that they operate simultaneously. For example, members 30, 36 may be operated by solenoids which are automatically switched together.

Figure 2:
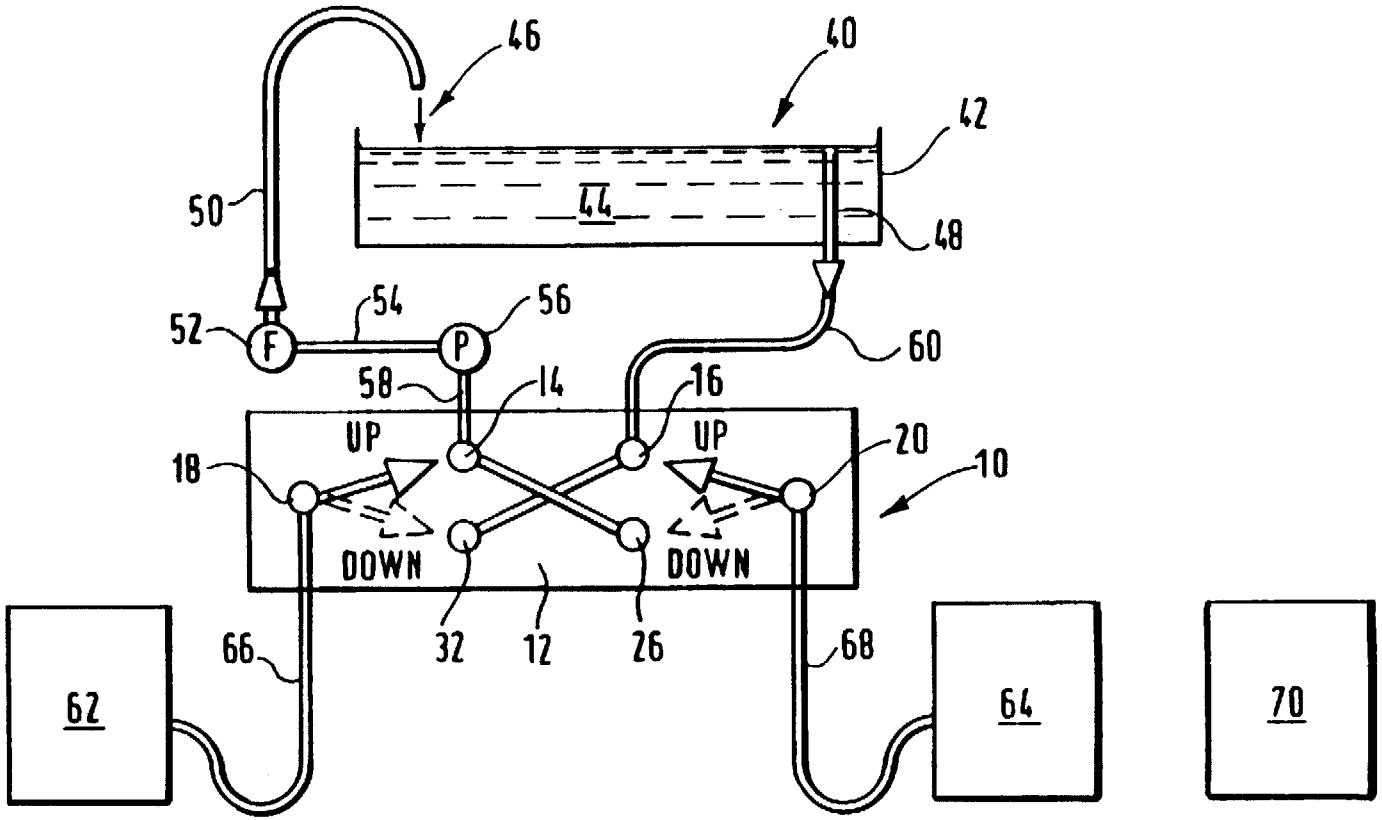
FIG. 2 is a schematic view illustrating the connection of the valve arrangement shown in FIG. 1 to a photographic process.

Referring now to FIG. 2, connection of valve arrangement 10 to a process is shown. Valve arrangement 10 is connected to a process 40 by 'inlet' and 'outlet' ports 14, 16 as described above. The process 40 comprises a tank 42 containing solution 44. Solution is input to the tank 42 through inlet 46 and solution is removed from the tank 42 through outlet 48.

Inlet 46 is connected to 'inlet' port 14 of valve arrangement 10 through connection 50, flow meter 52, connection 54, pump 56 and connection 58. Pump 56 and flow meter 52 control the flow of solution to the inlet 46 of tank 42. Outlet 48 is connected to 'outlet' port 16 of valve arrangement 10 via connection 60.

Ports 16, 18 are connected to respective 'bag-in-box' arrangements 62, 64 via respective connections 66, 68. Each 'bag-in-box' arrangement 62, 64 has a single 'dry-break' connection (not shown) to which connections 66, 68 are connected. Each 'dry-break' connection prevents solution leaking from the 'bag-in-box' arrangement when it is disconnected from a source of solution.

A further 'bag-in-box' arrangement 70 is shown which is used to replace an emptied 'bag-in-box' arrangement.

With members 30, 36 in the 'UP' position, as shown by solid lines, 'bag-in-box' arrangement 62 is connected to inlet 46 for supplying fresh solution to the process, and 'bag-in-box' arrangement 64 is connected to outlet 48 for collecting used solution from the process.

Similarly, with members 30, 36 in the 'DOWN' position, as shown by dotted lines, 'bag-in-box' arrangement 64 is connected to inlet 46 for supplying fresh solution to the process, and 'bag-in-box' arrangement 62 is connected to outlet 48 for collecting used solution from the process.

This means that by connection to valve arrangement 10, a single 'bag-in-box' arrangement can be used first to supply fresh solution to the process, and then when the 'bag-in-box' arrangement is empty, it can be used to collect used solution from the process. A further 'bag-in-box' arrangement 70 can then be connected to supply fresh solution to the process.

Without the valve arrangement 10, a 'bag-in-box' arrangement, once emptied of fresh processing solution, can be re-used to collect the used processing solution from the process. However, this means that the 'bag-in-box' arrangement will need to be connected and disconnected several times, and means (not shown) will need to be provided to ensure that the 'bag-in-box' arrangement is sucked as flat as possible as it is emptied, and that no air enters the 'bag-in-box' arrangement as it is disconnected from the inlet side of the process and connected to the outlet side thereof.

Figures 3A, 3B, 3C:
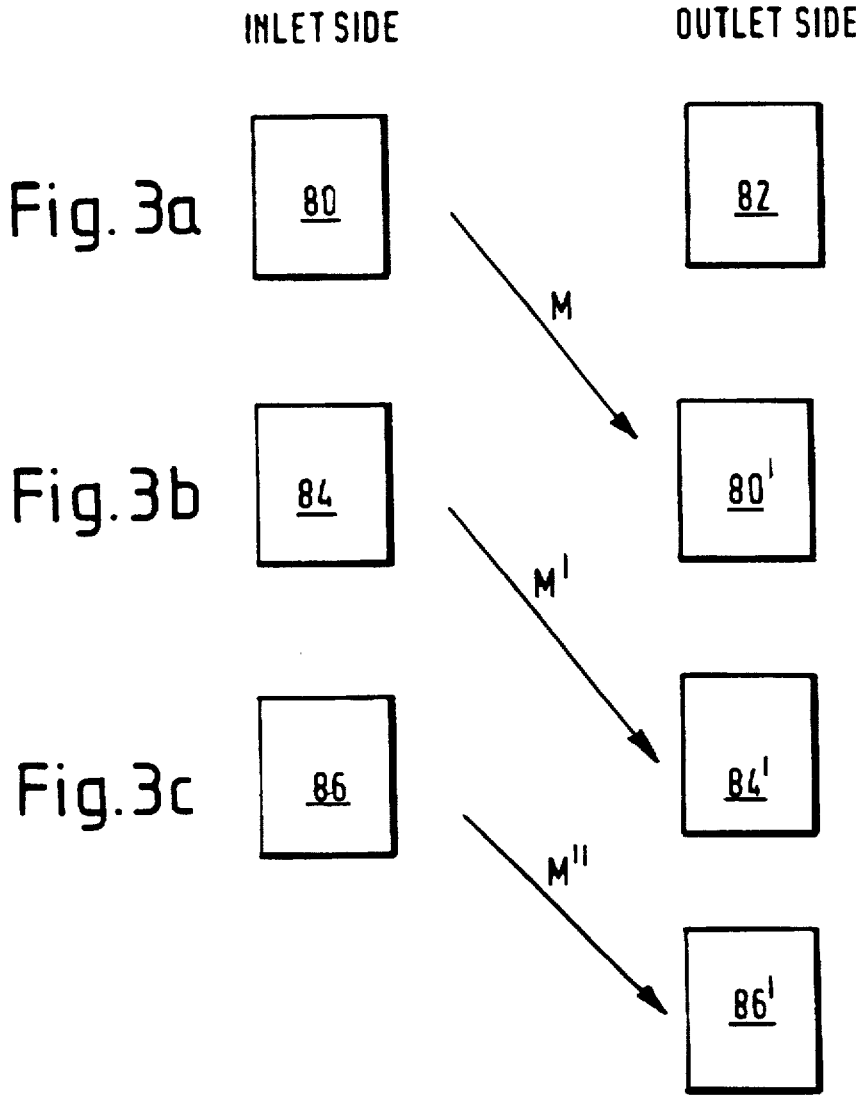
FIG. 3 illustrates the number of movements required in photographic processing apparatus not embodying the valve of the present invention.

As shown in FIG. 3(*a*), at the start of the process, 'bag-in-box' arrangement 80 full of replenisher solution is connected to the inlet side of the process and empty 'bag-in-box' arrangement 82 connected to the outlet side. When 'bag-in-box' arrangement 82 becomes full with used processing solution, it is disconnected from the outlet side and removed. 'Bag-in-box' arrangement 80 is then disconnected from the inlet side and moved to the outlet side and connected thereto, as shown by 80' in FIG. 3(*b*), as indicated by arrow M. New 'bag-in-box' arrangement 84 is connected to the inlet side. When 'bag-in-box' arrangement 80' becomes full with used processing solution, it is disconnected from the outlet side and removed, FIG. 3(*c*), and emptied 'bag-in-box' arrangement 84 is disconnected from the inlet side and moved over to take the place of 'bag-in-box' arrangement 82, 'bag-in-box' arrangement 84', as indicated by arrow M'. A new 'bag-in-box' arrangement 86 is connected to the inlet side to replace 'bag-in-box' arrangement 84 and when empty is disconnected from the inlet side and moved and connected to the outlet side, in the direction of arrow M". This sequence of connection and disconnection is repeated as many times as necessary to supply fresh processing solution to the inlet side and to collect used processing solution from the outlet side of the process.

It will readily be appreciated that each 'bag-in-box' arrangement is connected and disconnected twice during its use, that is, connected and disconnected to both the inlet side and the outlet side of the process.

FIG. 4 illustrates the situation when the valve arrangement in accordance with the present invention is utilised. In this case, there are no specific inlet and outlet sides as the valve arrangement switches the connections between both sides. On one side of the process, generally shown as X, 'bag-in-box' arrangements 90, 92 are shown. Similarly, on the other side of the process, generally shown as Y, 'bag-in-box' arrangements 94, 96, 98 are shown. With the valve arrangement shown in FIGS. 1 and 2 connected in the 'UP' position, side X is the inlet side and 'bag-in-box' arrangement 90 is connected thereto with 'bag-in-box' arrangement 94, on side Y, connected to the outlet side of the process, FIG. 4(*a*).

When 'bag-in-box' arrangement 90 is emptied of fresh solution, and 'bag-in-box' arrangement 94 is full of used solution, valve arrangement 10 is switched so that it is connected in the 'DOWN' position. This means that side X becomes connected to the outlet side and side Y to the inlet, FIG. 4(*b*), and 'bag-in-box' arrangement 90 is disconnected from the inlet side and connected to the outlet side, 'bag-in-box' arrangement 90', with no physical movement thereof. At the same time, 'bag-in-box' arrangement 94 is disconnected from the outlet side and removed for disposal. A new 'bag-in-box' arrangement 96 is connected to the inlet side of the process.

Figures 4A, 4B, 4C, 4D:
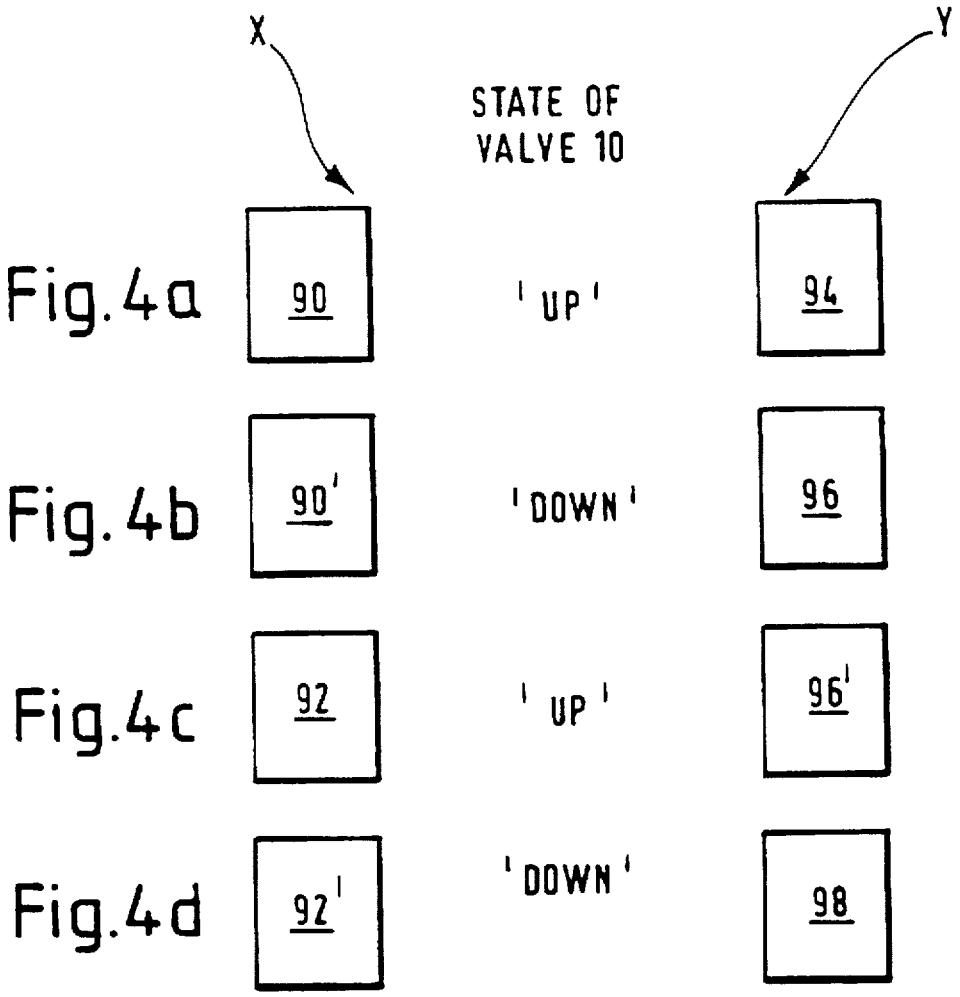
FIG. 4 is similar to FIG. 3, but illustrates the reduced number of movements required when utilising a valve in accordance with the present invention.

When 'bag-in-box' arrangement 96 is emptied of fresh solution and 'bag-in-box' arrangement 90 is full of used solution, valve arrangement 10 is switched back to the 'UP' position so that side X is again the inlet side and side Y the outlet side for the process. 'Bag-in-box' arrangement 90 is disconnected and removed for disposal. As shown in FIG. 4(c), 'bag-in-box' arrangement 96' is connected to the outlet side and a new 'bag-in-box' arrangement 92 connected to the inlet side.

When 'bag-in-box' arrangement 92 is emptied of fresh solution and 'bag-in-box' arrangement 96' is full of used solution, valve arrangement 10 is switched back to the 'DOWN' position so that side X is again the outlet side and side Y the inlet side for the process. 'Bag-in-box' arrangement 96' is disconnected and removed for disposal. As shown in FIG. 4(*d*), 'bag-in-box' arrangement 92' is connected to the outlet side and a new 'bag-in-box' arrangement 98 connected to the inlet side.

This procedure is repeated as long as the process in running and needs fresh processing solution supplied to it and used processing solution removed from it.

In this case, the only physical movement of the 'bag-in-box' arrangements is to connect each 'bag-in-box' arrangement to its correct side, that is, either side X or side Y. It will be appreciated that the number of connections and disconnections made are halved when compared to the FIG. 3 arrangement.

It will also be appreciated that new 'bag-in-box' arrangements are connected on alternate sides of the process and the valve arrangement providing the necessary switching and connections to the inlet and outlet sides of the process.

As a further alternative to the valve arrangement described above, four separate valves could be employed, the four valves being arranged in pairs connecting port 20 to ports 16 and 26 respectively and port 18 to ports 14 and 32 respectively. In such a case, only one valve of each pair would be open at any one time. This is shown schematically in FIG. 5.

Figure 5:
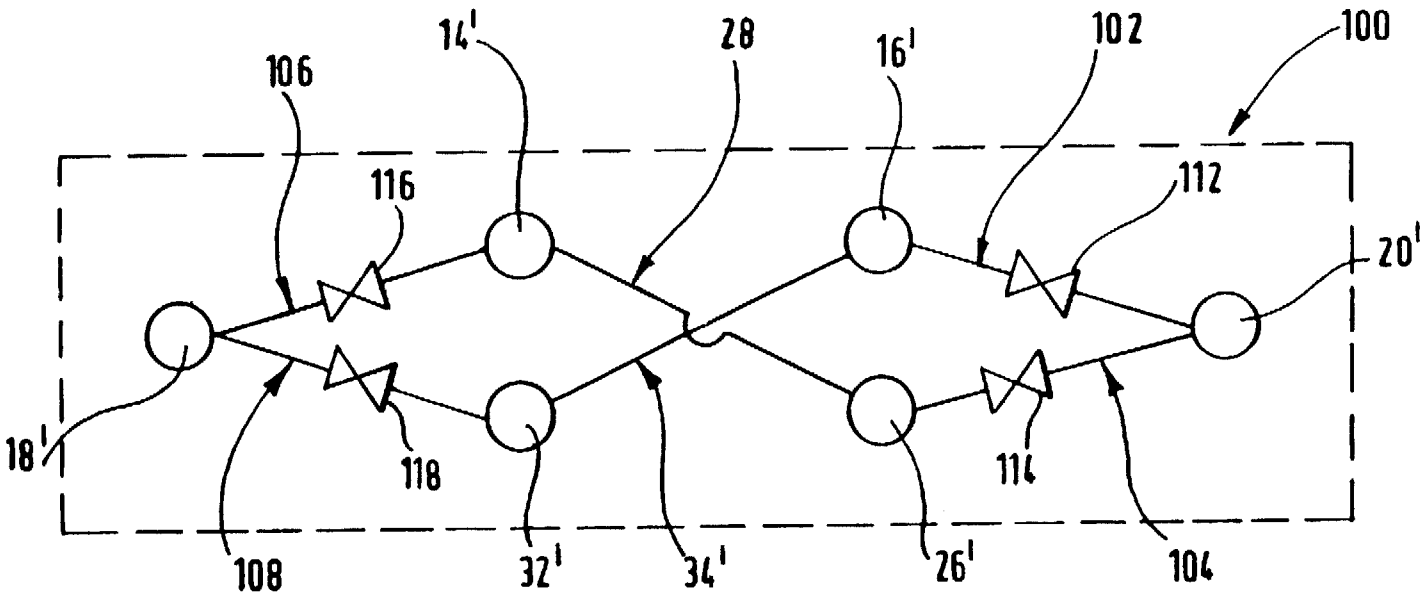
FIG. 5 is a schematic view of another embodiment of a valve arrangement in accordance with the present invention.

In FIG. 5, a valve arrangement 100 is shown. Parts already described with reference to FIG. 1 have a "'" added. Port 14' is shown connected to port 26' and port 16' to port 32' as before using respective connecting members 28', 34'. In accordance with this embodiment of the valve arrangement 100, port 16' is connected to port 20' by connecting member 102, port 20' to port 26' by connecting member 104, port 14' to port 18' by connecting member 106, and port 18' to port 32' by connecting member 108.

Valves 112, 114, 116, 118 are provided in a respective one of connecting members 102, 104, 106, 108. Valves 112, 114 and 116, 118 being arranged to operate as pairs, only one valve in each pair being open at any one time.

Moreover, operation of valve 112 is linked to operation of valve 116 so that if valve 112 is open, valve 116 is also open. If both valves 112, 116 are open, valves 114, 118 will be closed. This corresponds to the 'UP' position in FIG. 1.

Similarly, the operation of valves 114, 118 are linked and when both these are open, valves 112, 116 are both closed. This corresponds to the 'DOWN' position in FIG. 1.

An operator is alerted to the fact that a 'bag-in-box' arrangement connected to the outlet side of the process is full by means of an alarm. The operation of this alarm is described in our copending, commonly assigned U.S. patent application Ser. No. 08/633236 filed concurrently herewith (corresponding to British application No. 9507844.0 filed 18 Apr. 1995, entitled "Improvements Relating to the Collection of Process Effluent"), and incorporated herein by reference.

It will be appreciated that the two halves of the valve arrangement 10 can be operated individually, either manually or automatically. Furthermore, the two valves can be physically linked together. Alternatively, they may be a single unit which is switched automatically.

In order to utilise 'bag-in-box' arrangements with a photographic process as described above, it is preferred that each 'bag-in-box' arrangement is initially full of processing solution at working strength so that it can be fed directly to the process without any need for dilution or mixing.

When starting to feed solution to the process, an empty 'bag-in-box' arrangement is required for connection to the outlet side of the process. Starter solution in a full 'bag-in-box' arrangement is connected to the inlet side of the process and fed thereto. The process is run with processing solution passing through it from a full 'bag-in-box' arrangement on the inlet side to an empty 'bag-in-box' arrangement on the outlet side.

When a 'bag-in-box' arrangement connected to the inlet side is emptied, it is sucked as flat as possible before being disconnected from the inlet side of the process and connected to the outlet side.

PARTS LIST

10 . . . valve arrangement
12 . . . body portion
14,16,18,20 . . . formed ports
14',16',26',32' . . . port
22,24 . . . two-way valves
26,32 . . . port
28,34 . . . fixed fluid connection member
28',34' . . . connecting members
30,36 . . . movable fluid connection member
40 . . . process
42 . . . tank
44 . . . solution
46 . . . inlet
48 . . . outlet
50,54,58,60,66,68 . . . connection
52 . . . flow meter
56 . . . pump
62,64,70,80,82,84,86,90,92,94,96,98 . . . "bag-in-box" arrangements
80',90', 96' . . . reconnected "bag-in-box" arrangement
100 . . . valve arrangement
102,104,106,108 . . . connecting member
112,114,116,118 . . . valves

We claim:

1. A method of handling processing solutions for a photographic process using at least one flexible container capable of containing processing solution, the flexible container having a single connector by which it is connected to the process, the process having an inlet side through which fresh processing solution is introduced thereto and an outlet side from which used processing solution is removed therefrom, the method comprising the steps of:

a) providing at least one flexible container connected to the inlet side of the process for supplying processing solution thereto, the supply flexible container being initially substantially full of fresh processing solution;

b) providing at least one waste flexible container connected to the outlet side of the process for collecting used processing solution therefrom, the waste flexible container being initially substantially empty;

c) supplying fresh processing solution to the inlet side of the process;

d) collecting used processing solution from the outlet side of the process;

e) removing each waste flexible container from the outlet side of the process when it is substantially full;

f) switching each substantially emptied supply flexible container from the inlet side of the process to the outlet side of the process to replace a respective one of the removed waste flexible container;

g) providing at least one further supply flexible container; and h) connecting each further supply flexible container to the inlet side of the process;

characterized in that step f) is carried out by a valve arrangement with no physical movement of each flexible container.

2. A method according to claim 1, wherein each supply and waste flexible container is located in respective first and second positions relative to the process, steps e), g) and h) being carried out in alternately in the first or second position, the valve arrangement effectively switching connections between each flexible container and the inlet and outlet sides of the process.

3. A method according to claim 1, wherein each flexible container comprises a 'bag-in-box' arrangement comprising an outer liquid-tight container inside which a flexible bag is located.

4. A method according to claim 3, wherein the 'bag-in-box ' arrangement includes a self-sealing, dry-break connector.

5. A valve arrangement for handling processing solutions for a photographic process using at least one flexible container capable of containing processing solution, the flexible container having a single connector by which the flexible container is connected to the process, the process having an inlet side through which fresh processing solution is introduced to the process and an outlet side from which used processing solution is removed from the process, the valve arrangement comprising:

a body portion;

a first port for connection to the inlet side of the process;

a second port for connection to the outlet side of the process;

third and fourth ports for connection to respective ones of a flexible container for fresh processing solution and a flexible container for used processing solution; and fluid connection means for connecting the first and second ports with the third and fourth ports;

wherein the fluid connection means includes a switching arrangement for selectively connecting the first port with either one of the third and fourth ports and the second port with the other of the third and fourth ports.

6. An arrangement according to claim 5, wherein the selective connection is simultaneous.

7. Photographic processing apparatus of a type for performing a photographic process using at least one flexible container capable of containing processing solution, the flexible container having a single connector by which the flexible container is connected to the apparatus, the apparatus having an inlet side through which fresh processing solution is introduced to the apparatus and an outlet side from which used processing solution is removed from the apparatus, the apparatus including a valve arrangement comprising:

a body portion:

a first port for connection to the inlet side of the apparatus;

a second port for connection to the outlet side of the apparatus:

third and fourth ports for connection to respective ones of a flexible container for fresh processing solution and a flexible container for used processing solution; and fluid connection means for connecting the first and second ports with the third and fourth ports:

wherein the fluid connection means includes a switching arrangement for selectively connecting the first port with either one of the third and fourth ports and the second port with the other of the third and fourth ports.

8. A photographic processing apparatus according to claim 7, wherein the selective connection is simultaneous.

* * * * *